US005828285A

United States Patent [19]

Hofsäss

[11] Patent Number: 5,828,285

[45] Date of Patent: Oct. 27, 1998

[54] HOLDER FOR A BIMETALLIC SWITCHING DEVICE

[76] Inventor: Marcel Hofsäss, Bodelschwinghstr. 36, D-75179 Pforzheim, Germany

[21] Appl. No.: 610,162

[22] Filed: Feb. 29, 1996

[30] Foreign Application Priority Data

Mar. 3, 1995 [DE] Germany ..... 195 07 488.2

[51] Int. Cl.[6] ..... H01H 37/04

[52] U.S. Cl. ..... 337/112; 337/3; 337/113; 337/380

[58] Field of Search ..... 337/3, 13, 34, 337/112, 333, 372, 380, 113

[56] References Cited

U.S. PATENT DOCUMENTS 3,031,565 4/1962 Appleton .

FOREIGN PATENT DOCUMENTS 0 315 262 A1 5/1989 European Pat. Off. .
0 638 983 A2 2/1995 European Pat. Off. .
8607370 U 8/1987 Germany .
3817080 A1 12/1988 Germany .
9004941 U 7/1991 Germany .
9004943 U 7/1991 Germany .
9214543 U 2/1993 Germany .
9301874 U 8/1993 Germany .
2049291 12/1980 United Kingdom .

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

A pre-assembled holder (11) for a bimetallic switching device (12) in a temperature-dependent switch (10) comprises a supporting part (13) made of an electrically insulating material and two electrically conductive contact parts (14, 15) which are fastened to the supporting part (13) before the switching device (12) is inserted. The holding ends (24, 25) of the two electrically conductive contact parts (14, 15) protrude beyond the supporting part (13) and are designed to bear and clamp the switching device (12) between them outside the supporting part (13). An insulating cap (31) can be placed over the holding ends (24, 25) after the switching device (12) has been inserted (FIG. 1).

12 Claims, 2 Drawing Sheets

HOLDER FOR A BIMETALLIC SWITCHING DEVICE

BACKGROUND OF THE INVENTION

The present invention relates to a holder for a bimetallic switching device in a temperature-dependent switch with a supporting part made of electrically isolating material on which two electrically conductive contact parts are held.

The invention also relates to a temperature-dependent switch with such a holder in which a bimetallic switching device is clamped.

RELATED PRIOR ART

Such a holder and so-called temperature controller are known from DE 90 04 941 U.

The known temperature controller comprises a frame of plastic on the top and bottom of which an electrically conductive contact plate is snap fitted. There is a bimetallic switching device in the frame which is clamped between the contact plates. The contact is hereby made by pressing the upper contact plate against the cover and the lower contact plate against the base of the switching device.

The frame has snap-in projections which are overlapped by hook-like lugs on the contact plates so that these snap-in locking devices exert a pressure on the top and bottom of the switching device.

When assembling the temperature controller the upper contact plate is first snapped in place on the frame before the switching device is inserted into the frame from below. The lower contact plate is then fitted from below so that the switching device is clamped tight between the two contact plates, whereby the snap-in projections on the frame parts form the counter support for the clamping forces.

A disadvantage of the known holder and the temperature controller assembled with this is that the mechanical tolerances of the sheet metal parts and the plastic frame must be very low so that the necessary contact forces can be applied. However, since these temperature controllers are mass-produced articles, the sheet metal parts and plastic frames are produced in very large numbers, whereby the tolerances cannot always be observed. Moreover, these individual parts are delivered to the manufacturers in large batches, whereby the sheet metal parts in the batch are often bent during transportation or loading/unloading.

All of these factors lead to a high spoilage during assembly of the known temperature controllers, which on the whole increases the manufacturing costs of the temperature controller.

A further disadvantage of the known temperature controller relates to the necessary safe contact between the bimetallic switching device and the contact plates which form the external contacts. Since the contact forces are applied by bent lugs on the contact plates, this contact is often inadequate for long-term requirements since the high loads in everyday use, e.g. due to the continuous vibration of the devices protected by the temperature controller, weaken the snap-in locking device. The safe contact can no longer be guaranteed even after a very short service life particularly if the tolerances of the assembled components come together in an unfavourable constellation.

It is generally known that during the manufacture of such temperature controllers the connection technology, in other words the connection of the possibly encapsulated bimetallic switching device to the external terminals, is very wage intensive and requires the stockpiling of numerous individual parts. Moreover, the known temperature controllers or their holders can only be assembled manually, which not only entails high costs but also increases the number of rejects.

On the whole, the high manufacturing costs due to wage intensive assembly, the high number of rejects and the stockpiling costs associated with the manufacturing are regarded as disadvantageous for the known temperature controllers and their holders. A further disadvantage of the known temperature controller is the uncertain contact reliability, particularly during long-term operation.

It is common for a temperature controller to be manufactured with a multi-part plastic housing into which the bimetallic switching device and contact plates are initially inserted during assembly before a cover is joined to the housing, e.g. through hot sealing, to ensure a pressurised contact between the inserted parts. Pressure has to continue to be applied for approx. one second following the actual hot sealing process to prevent the sealed plastic parts from separating during the cooling phase.

These temperature controllers have the same disadvantages as those already discussed in detail in the above. The hot seal joint can come apart due to the vibrations experienced during use, the mechanical tolerances can lead to a low contact reliability and the necessary manufacturing time unwelcomely increases the manufacturing costs.

DE 93 01 874 U mentions the use of a temperature-dependent switching device between a pair of spring clips which only serve as a mechanical fixture with no electrical contacts.

SUMMARY OF THE INVENTION

In view of the above it is an object of the present invention to provide a holder and temperature controller of a simple construction which is economical and easy to install and functions reliably in long-term operation.

With the holder of the type mentioned at the outset this object is achieved in that the holder is pre-assembled and designed in such a way that both contact parts are fastened to the supporting part before insertion of the switching device, that their holding ends protrude beyond the supporting part and that the switching device can be clamped between these outside the supporting part.

With respect to the temperature controller mentioned at the outset, this object is achieved in that this comprises the new holder and a switching device inserted between the holding ends of the contact parts.

The object underlying the invention is thus achieved in full. The new holder is initially pre-assembled by fastening the two contact parts, whose holding ends protrude beyond the supporting part to form a seat for the switching device, to this supporting part. This holder can be stored as a pre-assembled component so that the number of individual parts for final assembly of the temperature controller is significantly reduced. This holder itself can be assembled by a supplier specialising in such sheet metal or plastic technologies. The manufacturer of the temperature controller itself then purchases these pre-assembled holders into which the switching devices which they themselves manufacture only have to be inserted. However, these switching devices can also be supplied as semi-finished products and clipped in place directly by the manufacturer of the electrical consumer which is to be protected. This means that it is possible to do without former joining technologies such as soldering, welding, screwing, etc., which also significantly cuts the manufacturing costs for the producer of the electrical consumer.

The concomitant shallower manufacturing process also significantly reduces the manufacturing costs for the temperature controller on account of the fewer individual components and the reduced stockpiling costs. Furthermore, the costs are also reduced by the very simple assembly, the switching device can be inserted into the pre-assembled holder by automatic production equipment.

Moreover, the very simple construction of the new holder and the temperature controller assembled using this part proves advantageous since a clamping outside the housing of the supporting part ensures a high contact reliability and associated long service life, whereby there are no tolerance problems on account of the simple construction so that rejects are also reduced.

Thus the new holder and the new temperature controller generally display an increased product reliability at lower costs.

It is then preferred if the holding ends are held under an initial stress by the supporting part when the switching device is inserted between the holding ends.

This measure is advantageous with a view to the simple construction since the holding ends protrude from the supporting part in which they are "clamped" in the manner of cantilevers, as it were. The holding ends are now bent apart by an inserted switching device so that high contact forces arise which ensure a safe mechanical hold and safe electrical connection to fulfill the high requirements of everyday use.

It is of further advantage if the holder has an insulating cap which can be placed over the holding ends, which at least partly covers the switching device when in place and which presses the holding ends against the switching device.

This measure increases the contact reliability between the contact parts and the switching device in an advantageous and constructionally simple manner, whereby it simultaneously achieves an insulation of the switching device and holding ends. The insulating cap can also be fitted using automatic production equipment so that the manufacturing costs are hardly increased, particularly since the insulating cap is a plastic part which can be produced cheaply. On the whole this measure significantly improves the product integrity with hardly any rise in the manufacturing costs. The improved mechanical and functional reliability is also guaranteed by the fact that the insulating cap not only envelopes the switching device but also holds this in an immovable position so that damages to an assembled temperature controller in unfavourable circumstances, e.g. during transportation as bulk goods, can be prevented.

It is then preferred if the contact parts are cast in the supporting part.

This measure has constructive and cost advantages since the prefabricated contact parts are only injected or cast in pairs in the supporting part in a plastic injection moulding machine so that the supporting part can be manufactured and the contact parts connected to the supporting part in one single manufacturing stage.

On the other hand it is preferred if the contact parts are inserted or shot into the supporting part so that they snap into place.

This measure advantageously enables the separate production of the contact parts and supporting part whereby the externally supplied contact parts can be inserted, snapped into place or "shot" into the supporting parts after manufacture using production lines or machines available in the plastic industry. Such manufacturing methods are in common use so that the prefabricated holders can be produced at very low cost.

It is further preferred if the contact parts comprise terminal ends which protrude beyond the supporting part.

In this constructionally advantageous manner it is possible to implement customer-specific connection technologies, the terminal ends can be designed as clamping lugs, soldering tags or guide pins depending on the specifications.

It is furthermore preferred if at least one of the holding ends has a snap-in locking device, preferably a snap-in lug or a projection.

The advantage of this is that the snap-in lug or projection ensures that the inserted switching device is held without being lost since in addition to the clamping forces which ensure a frictionally engaged fixture of the switching device in the holder, the snap-in lug also provides a positive interlock.

With the new bimetallic switching device, which is thus a semi-finished product, it is then preferred if it comprises at least one snap-in holding device, preferably a recess.

This measure offers the same advantages as those discussed above in connection with the snap-in lug on one of the holding ends. Naturally, it is also possible to provide a snap-in lug on the bimetallic switching device and a recess on the holding end.

In the new temperature controller it is preferred if a protective cap is provided which at least partly encloses the switching device and whose sides which face the holding ends display openings through which the switching device makes contact with the holding ends.

This separate protective cap on the one hand provides mechanical protection and electrical insulation for the switching device, thus increasing operational reliability. On the other hand it permits the switching device to be snapped in place with the holding ends, as already discussed in connection with the aforementioned snap-in lug.

It is then preferred if the protective cap has at least one guide groove running radially outwards from one of the openings which matches a snap-in lug on the opposite holding end.

This measure is on the one hand advantageous during assembly since when the protective cap containing the switching device is inserted between the holding ends the snap-in lug of one holding end can run in this guide groove so that the insertion process is guided and there is no jamming or distortion. The snap-in lug then engages in the corresponding opening of the guide groove and ensures not only a positive interlock between the protective cap and holder but also a reliable electrical contact at the same time. The protective cap namely ensures that the contact area between the snap-in lug and the cover or base of the switching device is protected against external influences.

On the other hand it is preferred if the protective cap is provided with terminal areas which are connected to the switching device and which make contact with the holding ends when the protective cap is inserted between these.

The advantage of this is that switching devices can also be used which themselves cannot bear high contact pressures. These switching devices can now be inserted in the protective cap and connected to its terminal areas, whereby the protective cap can bear a very high contact pressure itself on its terminal areas. In the case of encapsulated switching devices which generally have a housing with a metallic cover and a metallic base closed by this, the contact can of course be made directly via this cover and base. The contact forces in this case can be up to 50 kp, which even with a purely frictionally engaged connection between the holding ends and switching device leads to a very firm mechanical fit.

Further advantages can be derived from the following description.

It is understood that the aforementioned features and those to be explained in the following can be used not only in the specified combinations but also in other combinations or alone without going beyond the scope of the present invention.

BRIEF DESCRIPTION OF THE DRAWINGS

The invention is shown in the drawings and will be explained in more detail in the following. In the drawings.

DETAILED DESCRIPTION OF A PREFERRED EMBODIMENT

Figure 1:
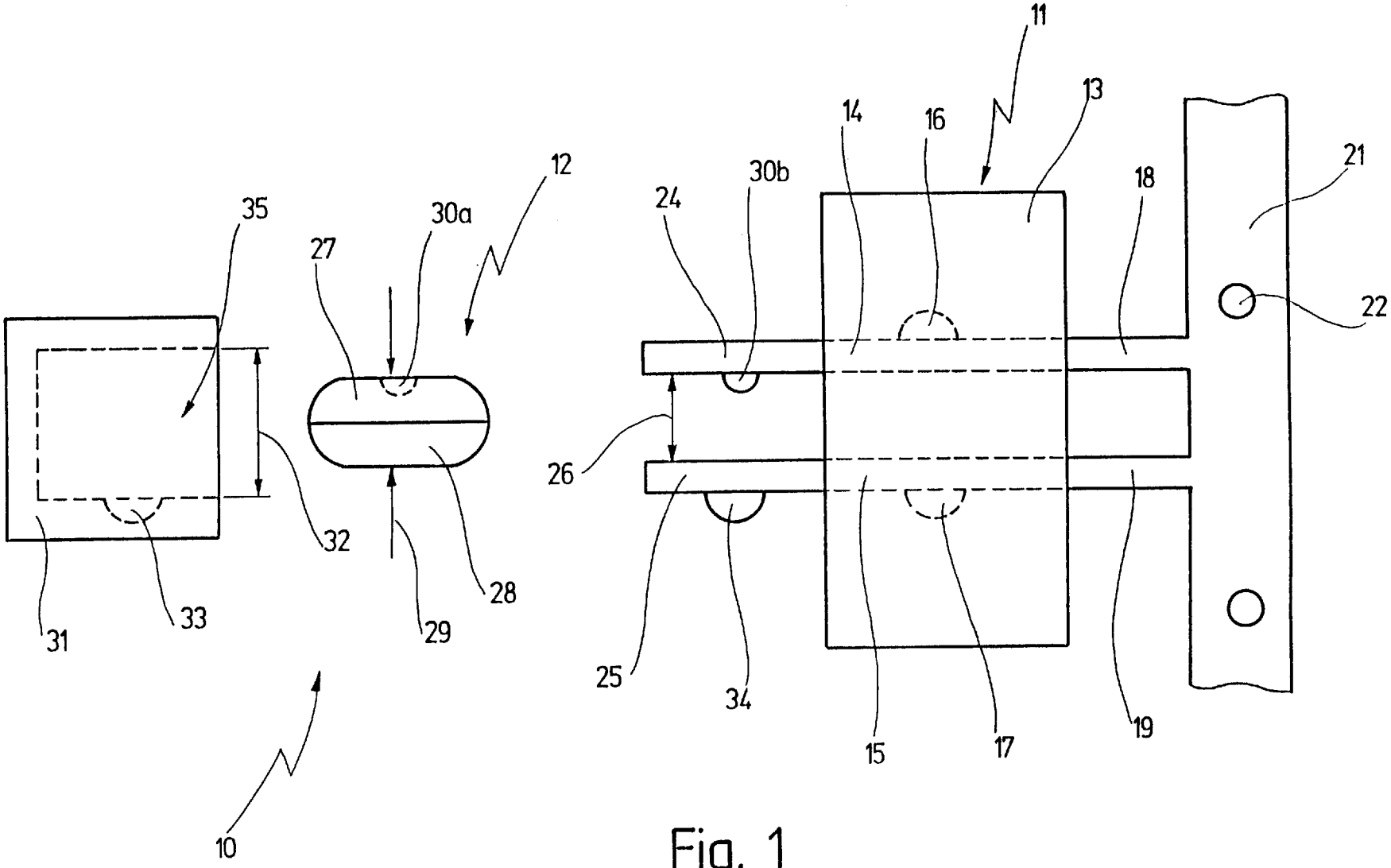
FIG. 1 is a side view of an exploded drawing of the new temperature controller with pre-assembled supporting part, bimetallic switching device and insulating cap.

FIG. 1 in general shows an exploded diagram of a temperature controller 10 comprising a pre-assembled holder 11 as well as a bimetallic switching device 12 which is to be accommodated and held in the pre-assembled holder 11 in a manner still to be described.

The holder 11 comprises a supporting part 13 made of an electrically insulating material on which two contact parts 14, 15 are held. The contact parts 14, 15 are made of electrically conductive material, preferably metal, and cast in or injection moulded with the supporting part 13. For this purpose the contact parts 14, 15 have projections 16, 17 which prevent the contact parts 14, 15 from being pulled out of the supporting part 13.

Alternatively, it is also possible to initially cast or inject the supporting part 13 of plastic, whereby through holes are left open to receive the contact parts 14, 15. The contact parts 14, 15 are then subsequently inserted into the supporting part 13 ("shot in").

The contact parts 14, 15 protrude beyond the supporting part 13 on both sides and display terminal ends 18, 19 to the right in FIG. 1 with which they are fastened to a conveying belt 21. This conveying belt 21 displays familiar feed holes 22 and serves to hold the contact parts 14, 15 and/or ready assembled holder 11 in place ready for use.

Holding ends 24, 25 of the contact parts 14, 15 which face each other and between which there is a gap 26 protrude over the other end of the supporting part 13. Naturally, the holding ends 24, 25 are relatively thin in the plane of the drawing in FIG. 1 whereas they are much thicker vertical to this plane, roughly corresponding to the diameter of the bimetallic switching device 12.

The switching device 12, comprising a cover 27 and base 28, displays a thickness indicated by 29 which is slightly larger than the gap 26. If the switching device 12, which can be supplied as a semifinished product for example, is now inserted between the two holding ends 24, 25 these are pushed apart in the manner of cantilever girders held in the supporting part 13 thus producing a frictionally engaged connection between the holding ends 24, 25 and the cover 27 or base 28. With a suitable choice of material for the contact parts 14, 15, gaps 26 and 29 as well as material for the supporting part 13, forces of up to 50 kp can be exerted on the inserted switching device 12. This not only guarantees a very safe mechanical hold of the switching device 12 in the holder 11, the electrical contact is also very reliable.

The pre-assembled holder 11 can now be pre-assembled, or pre-assembled by the manufacturer of the plastic supporting part 13, in the manner shown on the right of FIG. 1. During final assembly the switching device then only has to be inserted between the holding ends 24, 25 by automatic production equipment where it is safely held and contacted through the choice of the thickness 29 and the gap 26. When choosing these dimensions it is also possible to take into account possible tolerances during manufacture so that a firm hold can be guaranteed even with an unfavourable constellation of tolerances, whereas in the event of an addition of tolerances in the opposite direction the pressure exerted on the switching device 12 does not exceed a certain maximum value.

Alternatively or additionally a recess 30*a* can be provided on the switching device 12 and a snap-in lug 30*b* on the upper holding end 24 which interlock when the switching device 12 is inserted into the holder 11 and ensure a good mechanical hold of the switching device 12.

FIG. 1 also shows an insulating cap 31 whose opening 32 can be chosen so that it can be pushed over the holding ends 24, 25 and presses these together against the switching device 12. Even with unfavourable tolerances, the insulating cap 31 thus ensures a safe fit of the in the holder 11. The insulating cap 31 has a recess 33 on switching device its inside which is aligned with a lug 34 on the holding end 25 so that the fitted insulating cap catches in the holder 11.

The internal profile 35 of the insulating cap 31 thus also ensures electrical insulation and mechanical protection for the switching device 12.

Figure 2:
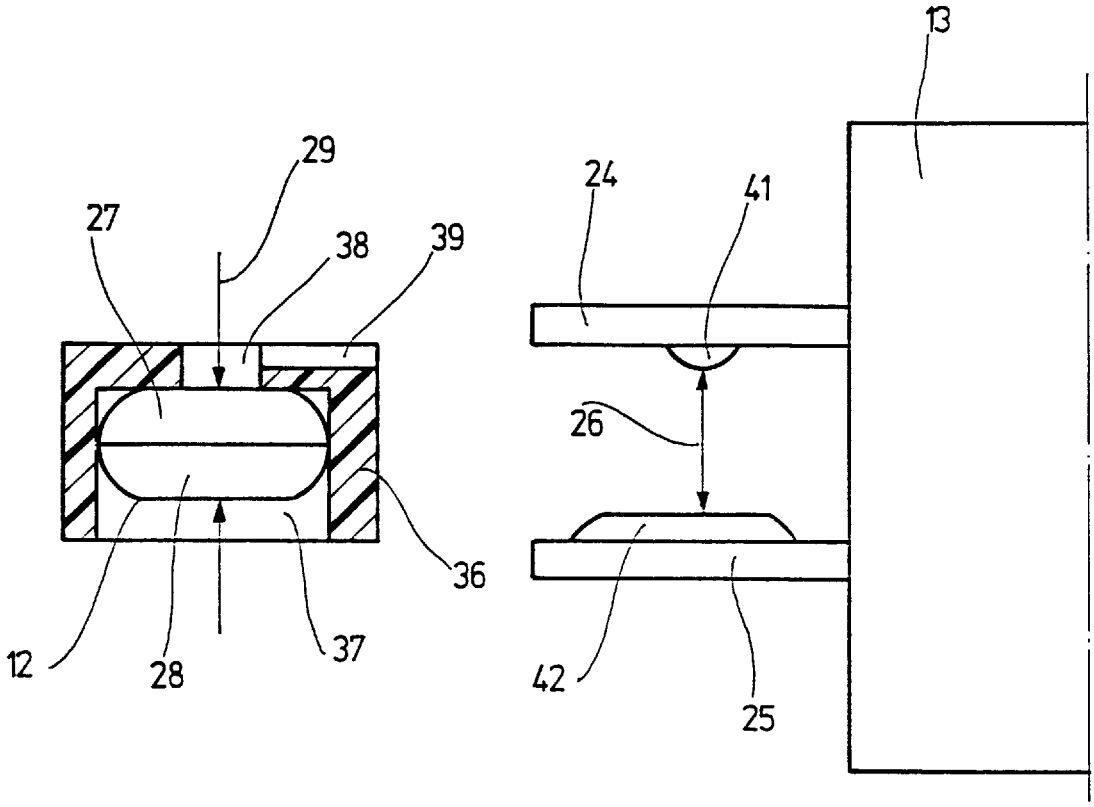
FIG. 2 is an enlarged drawing of a section of FIG. 1, whereby the bimetallic switching device is accommodated in a protective cap shown in section.

FIG. 2 shows that the switching device 12 is located in a protective cap 36 whose base opening has been selected so that the switching device 12 can be inserted from below into the protective cap 36. The protective cap 36 has an upper opening 38 opposite the base opening 37 which is adjoined by a radial guide grove 39 open on the outside. In the sectional drawing of the protective cap 36 selected for FIG. 2 it can be seen that the guide groove 39 is shallower than the upper opening 38.

The guide groove 39 is assigned a snap-in lug 41 on the upper holding end 24, whereas the base opening 37 is assigned a cap 42 on the lower holding end 25.

When the protective cap 36 containing a switching device 12 is inserted between the holding ends 24, 25 the snap-in lug 41 moves in the guide groove 39 , thus preventing a jamming. When the protective cap 36 has been inserted far enough between the holding ends 24, 25, the cap 42 catches in the base opening 37 and makes contact with the base part 28. At the same time the snap-in lug 41 catches in the upper opening 38 and makes contact with the cover 27. In this manner the protective cap 36 containing the switching device 12 is captured in the holder 11, whereas the snap-in lug 41 and cap 42 are pressed against the cover 27 and base 28 with a safe contact by the pressure of the holding ends 24, 25.

Figure 3:
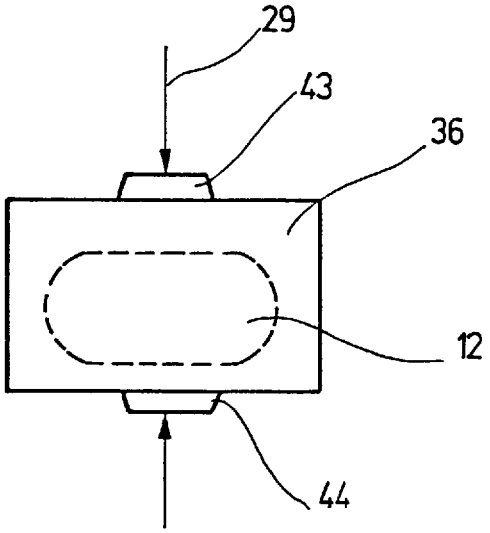
FIG. 3 is a further protective cap provided with terminal lugs.

FIG. 3 shows an alternative design for the protective cap 36 whereby terminal areas 43, 44 are provided on this which are in electrical contact with a diagrammatically indicated switching device 12. This design is chosen if the switching device 12 itself cannot bear any forces or if the switching device 12 has a non-conductive housing so that the electrical contact is made via the terminal areas 43, 44 and the holding ends 24, 25.

What I claim is:

1. A pre-assembled holder for a bimetallic switching device of a temperature-dependent switch, said holder comprising:

a support part made of electrically isolating material; and two electrically conductive contact parts fastened to the supporting part and comprising each a holding end protruding beyond the support part said switching device being clamped between said holding ends outside the supporting parts.

2. The holder in accordance with claim 1, characterized in that the holding ends are held under an initial stress by the supporting part when the switching device is inserted between the holding ends.

3. The holder in accordance with claim 1, characterized in that it has assigned an insulating cap to be placed over the holding ends, which at least partly covers the switching device when in place and which presses the holding ends against the switching device.

4. The holder in accordance with claim 1, characterized in that the contact parts are cast or injected in the supporting part.

5. The holder in accordance with claim 1, characterized in that the contact parts are inserted or shot into the supporting part so that they snap into place.

6. The holder in accordance with claim 1, characterized in that the contact parts comprise terminal ends which protrude beyond the supporting part.

7. The holder in accordance with claim 1, characterized in that at least one of the holding ends has a snap-in locking device, preferably a snap-in lug or a projection.

8. A temperature-dependent switch comprising a holder in accordance with claim 1 and a switching device inserted between the holding ends of the contact parts.

9. The temperature-dependent switch in accordance with claim 8, characterized in that a protective cap is provided which at least partly encloses the switching device and whose sides which face the holding ends comprise openings through which the switching device makes contact with the holding ends.

10. The temperature-dependent switch in accordance with claim 9, characterized in that the protective cap has at least one guide groove running radially outwards from one of the openings which matches a snap-in lug on the opposite holding end.

11. The temperature-dependent switch in accordance with claim 9, characterized in that the protective cap is provided with electrically connecting areas which are connected to the switching device and which make electrical contact with the holding ends when the protective cap is inserted between these.

12. The temperature-dependent switch in accordance with claim 8, characterized in that the switching device has a snap-in part, preferably a recess, by which it is snapped in place with the holder.

* * * * *